US007314434B2

(12) United States Patent
Chen

(10) Patent No.: US 7,314,434 B2
(45) Date of Patent: Jan. 1, 2008

(54) DAMPER ADJUSTING DEVICE FOR EXERCISE APPARATUS

(76) Inventor: Chao-Chuan Chen, No. 15, Lane 9, Cheng Kung Road, Chin Jung Village, U Feng Hsian, Taichung Hsien (TW)

( * ) Notice: Subject to any disclaimer, the term of this patent is extended or adjusted under 35 U.S.C. 154(b) by 715 days.

(21) Appl. No.: 10/923,735

(22) Filed: Aug. 24, 2004

(65) Prior Publication Data

US 2005/0159274 A1 Jul. 21, 2005

(30) Foreign Application Priority Data

Jan. 20, 2004 (CN) ..... 2004 2 0001584 U

(51) Int. Cl.
*A63B 22/06* (2006.01)

(52) U.S. Cl. ..... 482/63; 188/164

(58) Field of Classification Search ..... 482/57–65, 482/903, 56, 51–53; 188/164
See application file for complete search history.

(56) References Cited

U.S. PATENT DOCUMENTS 5,031,901 A * 7/1991 Saarinen ..... 482/63
5,466,203 A * 11/1995 Chen ..... 482/63
6,095,953 A * 8/2000 Lee et al. ..... 482/57
6,162,152 A * 12/2000 Kuo ..... 482/63
7,004,888 B1 * 2/2006 Weng ..... 482/57
7,077,789 B1 * 7/2006 Chen ..... 482/63

* cited by examiner

*Primary Examiner*—Stephen R. Crow
(74) *Attorney, Agent, or Firm*—Bacon & Thomas, PLLC

(57) ABSTRACT

A damper adjusting device is mounted on a base of an exercise apparatus, including a resistance wheel, a pivoting member, a driving mechanism, and a biasing member. The resistance wheel is rotatably mounted on the base. The pivoting member is pivotably mounted on the base, having a driven portion and a resistance portion. The driving mechanism is mounted on the base, having a rotatable turntable and a lug formed on the turntable and spaced from a center of the turntable. The biasing member generates resilience for keeping the driven portion contacting against the lug. Accordingly, when the lug is driven to move to further drive the pivoting member to pivot for an angle, the distance between the resistance portion and the resistance wheel is also changed to shift the resistance generated while the resistance wheel turns.

4 Claims, 3 Drawing Sheets

DAMPER ADJUSTING DEVICE FOR EXERCISE APPARATUS

BACKGROUND OF THE INVENTION

1. Field of the Invention

The present invention relates generally to exercise apparatuses, and more particularly to a damper adjusting device for an exercise apparatus.

2. Description of the Related Art

A conventional exercise apparatus, such as exercise bicycle, stationary bike, elliptical walking machine, etc., is operated for exercise by driving the rotation of a resistance wheel, and an adjustment of the magnitude of the resistance generated while the resistance wheel is rotated can shift the difficulty levels of exercise. Referring to FIGS. 5 and 6, a conventional damper adjusting device 80 is mounted on a base 81 of an exercise apparatus, including a resistance wheel 82, a pivoting member 83, a support member 85, a driving mechanism 86, and a spring 88. The resistance wheel 82 is rotatably mounted to the base 81. The pivoting member 83 is pivotably mounted on the base 81 and positioned at a side of the resistance wheel 82, having a magnet set disposed at a resistance portion 84 corresponding in position to the resistance wheel 82. The support member 85 has a first arm portion 851 and a second arm portion 852, which have a predetermined included angle therebetween. The first arm portion 851 is pivotably mounted on the base 81 at a bottom end thereof and pivotably connected with the pivoting member 83 at a slot positioned at a top end thereof. The driving mechanism 86 has a stationarily rotatable cam 87 positioned above the second arm portion 852. The spring 88 has two ends connected respectively with the second arm portion 852 and the base 81 for generating resilience which keeps the second arm portion 852 contacting against a lateral surface of the cam 87. The second arm portion 852 can be pushed by the cam 87 or by the resilience of the spring 88 to drive the pivoting member 83 to pivot, such that the resistance portion 84 can be moved toward or away from the resistance wheel 82 to adjust the magnitude of the resistance.

However, the distance that the cam 87 drives the support member 85 to pivot is substantially equal to the length between the long radius and the short radius of the cam 87, and space inside the base 81 has to be sufficiently reserved for the rotation of the cam 87, such that the exercise apparatus is structurally large to be bulky and massive and to further incur inaesthetic appearance thereof. In addition, the magnitude of the resistance is adjusted by that the support member 85 drives the pivoting member 83 by means of the slot to change the distance between the magnet set and the resistance wheel, such that the whole process is complicated and more components are required to incur high production cost.

SUMMARY OF THE INVENTION

The primary objective of the present invention is to provide a damper adjusting device for an exercise apparatus; the damper adjusting device is structurally reduced and simplified.

The foregoing objective of the present invention is attained by the damper adjusting device, which is mounted on a base of the exercise apparatus and includes a resistance wheel, a pivoting member, a driving mechanism, and a biasing member. The resistance wheel is rotatably mounted on the base for stationary rotation driven by the user's doing exercise. The pivoting member is pivotably mounted on the base, having a driven portion and a resistance portion, which can be moved toward or away from the resistance wheel while the pivoting member pivots. The driving mechanism is mounted on the base, having a turntable and a lug. The turntable of the driving mechanism can be driven by a driving source to rotate. The lug of the driving mechanism is positioned on the turntable, spaced from a center of the turntable for a distance and positioned at a side of the driven portion of the pivoting member. The biasing member generates resilience for keeping the driven portion of the pivoting member contacting against the lug of the driving mechanism. Accordingly, when the lug is driven to move to further drive the pivoting member to pivot for an angle, the distance between the resistance portion and the resistance wheel is also changed to shift the resistance generated while the resistance wheel turns.

DETAILED DESCRIPTION OF THE INVENTION

Figure 1:
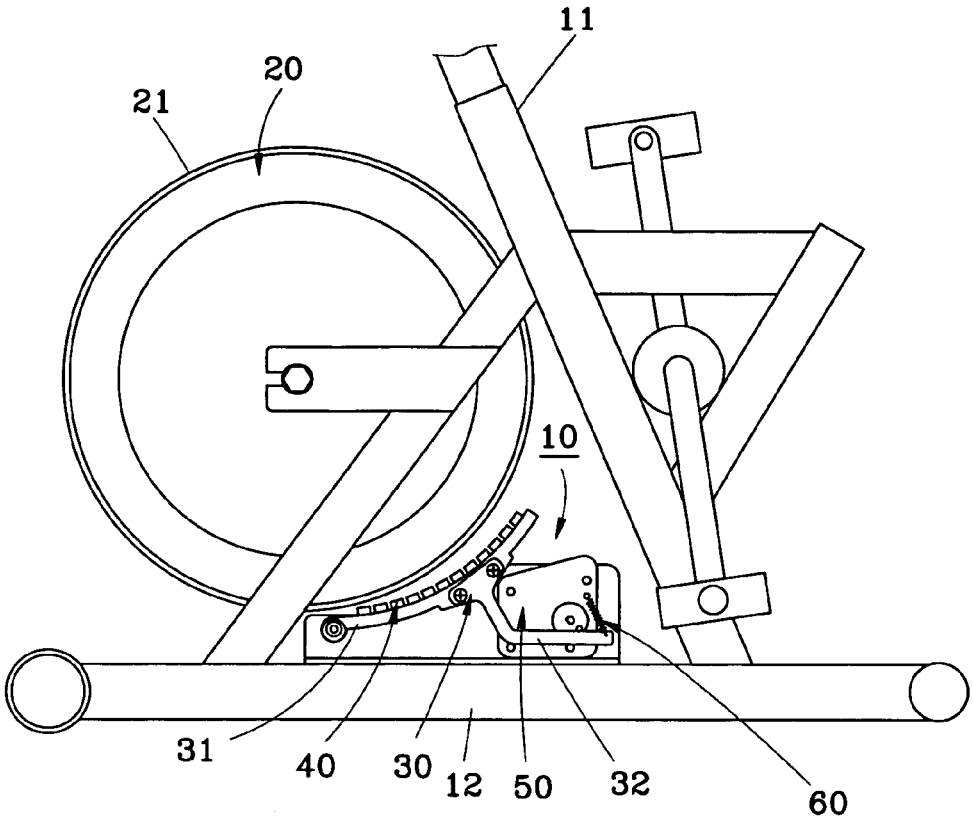
FIG. 1 is a side view of a first preferred embodiment of the present invention mounted on an exercise apparatus.

Referring to FIG. 1, a damper adjusting device 10 constructed according to a first preferred embodiment of the present invention is mounted on an exercise apparatus 11, which is an exercise bicycle having a base 12. The damper device 10 includes a resistance wheel 20, a pivoting member 30, a magnet unit 40, a driving mechanism 50, and a biasing member 60.

The resistance wheel 20 is rotatably mounted on the base 12 of the exercise bicycle 11 and is covered with a metallic layer 21 around an outer periphery thereof and can be driven to rotate stationarily while the user does cycling exercise.

The pivoting member 30 is pivotably mounted on the base 12 of the exercise bicycle 11, having a resistance portion 31 and a driven portion 32. The resistance portion 31 is arcuate in shape corresponding to the outer periphery of the resistance wheel 20. The driven portion 32 has a first arm 33 connected with the resistance portion 31 and a second arm 34 extending from the first arm 33 toward a direction away from the resistance potion 31.

The magnet unit 40 is mounted on the resistance portion 31 of the pivoting member 30, having a plurality of magnets 41 arranged serially.

The driving mechanism 50 is mounted on the base 12, having a driving source (not shown), a turntable 51, and a lug 52. The driving source is provided with a motor (not shown), a reduction gearbox 53 connected with an output shaft of the motor, and a shaft 54 that can be driven to rotate by the reduction gearbox 53. The turntable 51 is mounted to the shaft 54 to be driven to rotate by the driving source (not shown). The lug 52 is formed on the turntable 51, spaced from a center of the turntable 51 for a predetermined distance, and positioned above the second arm 34 of the pivoting member 30. When the turntable 51 is rotated, the lug 52 can be moved along a circular trajectory.

The biasing member 60, which is embodied as a tension spring in this embodiment, has a top end connected with the driving mechanism 50 and positioned over the driven portion 32, and a bottom end connected with the driven portion 32. The biasing member 60 generates rebounding resilience to keep the driven portion 32 contacting against the lug 52 of the driving mechanism 50.

Figure 2:
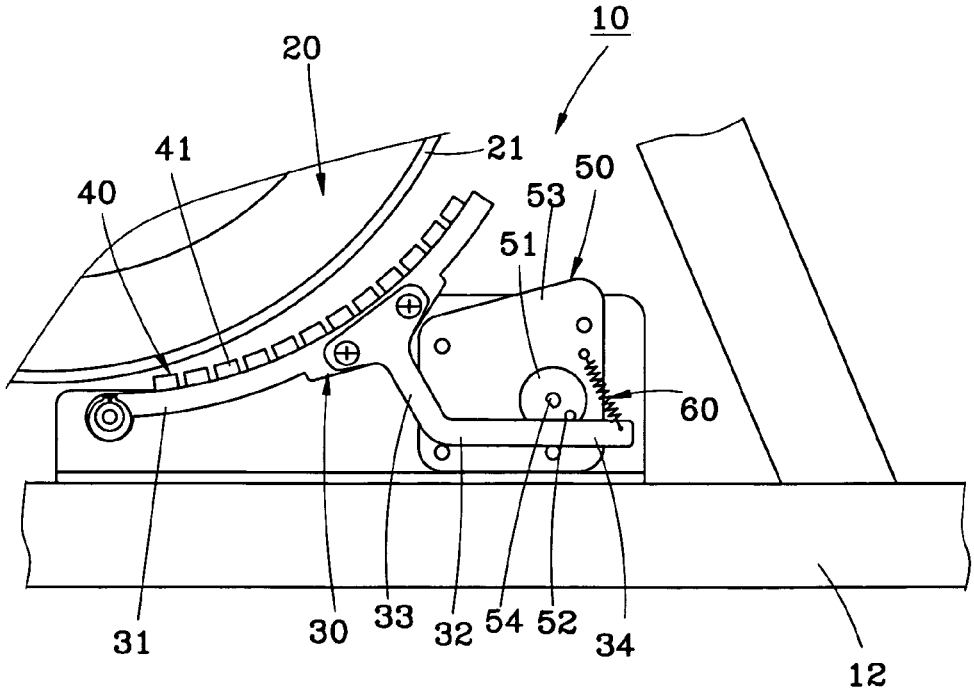
FIG. 2 is a partial enlarged view of the first preferred embodiment of the present invention, showing that a resistance portion of a pivoting member is away from a resistance wheel.
Figure 3:
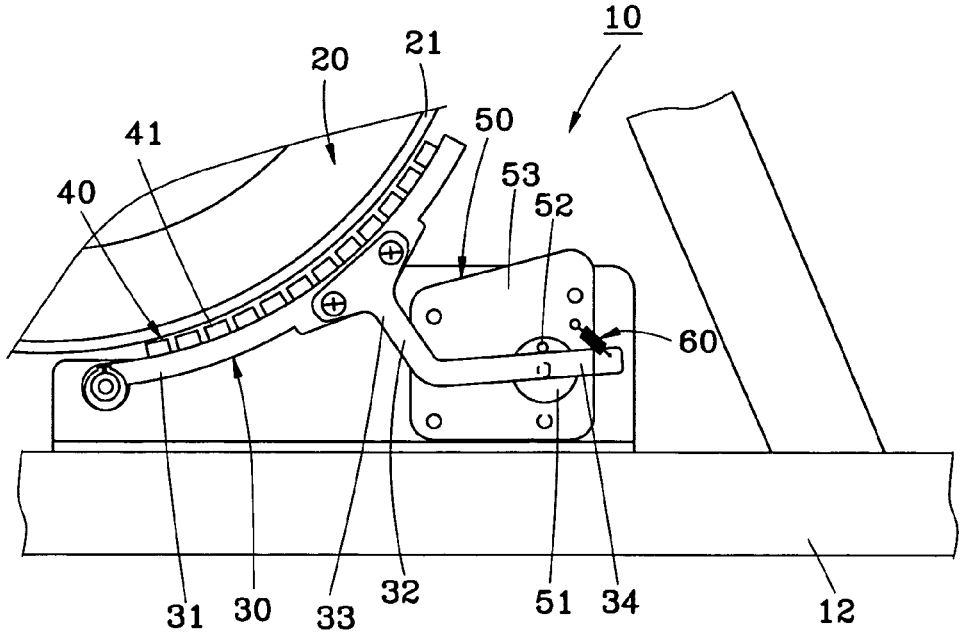
FIG. 3 is another partial enlarged view of the first preferred embodiment of the present invention, showing that the resistance portion of the pivoting member approaches the resistance wheel.

When the user uses the exercise apparatus 11 for cycling, the resistance wheel 20 is driven to rotate. In the meantime, the magnetism generated by the magnet unit 40 of the resistance portion 31 magnetizes the metallic layer 21 of the resistance wheel 20 to further generate resistance against the rotation of the resistance wheel 20. The user can adjust the distance between the resistance portion 31 and the resistance wheel 20 to shift the resistance for the user's demand. As shown in FIG. 2, the lug 52 is positioned at a lower side of the turntable 51 to push against the driven portion 32 of the pivoting member 30, such that the resistance portion 31 is moved away from the resistance wheel 20, thereby generating less resistance between the resistance portion 31 and the resistance wheel 20. When the user intends to enhance the resistance, drive the lug 52 to move upwards, as shown in FIG. 3, by means of the driving mechanism 50. Meanwhile, the driven portion 34 is pulled upwards by the rebounding resilience of the biasing member 60 to contact against the lug 52, and then the resistance portion 31 is moved to approach the resistance wheel 20, such that greater resistance is generated.

From the above recitation, the present invention is structurally simple and of less components to cause low production cost. In addition, the pivoting distance of the pivoting member 30 depends on the movement of the lug 52 which moving distance is substantially equal to the diameter of the turntable 51, thereby dramatically reducing more space inside the base 12 than the prior art. Further, the driven portion 32 and the resistance portion 31 are connected together to enable the lug 52 to directly drive the pivoting member 30 to pivot, such that the space inside the base 12 is effectively utilized.

Alternatively, the biasing member 60 can be mounted by that the top end thereof is connected with the base 12 over the driven portion 32 and the bottom end thereof is connected with the driven portion 32, or by that the top end thereof is connected with the base 12 over the resistance portion 31 and the bottom end thereof is connected with the resistance portion 31.

Figure 4:
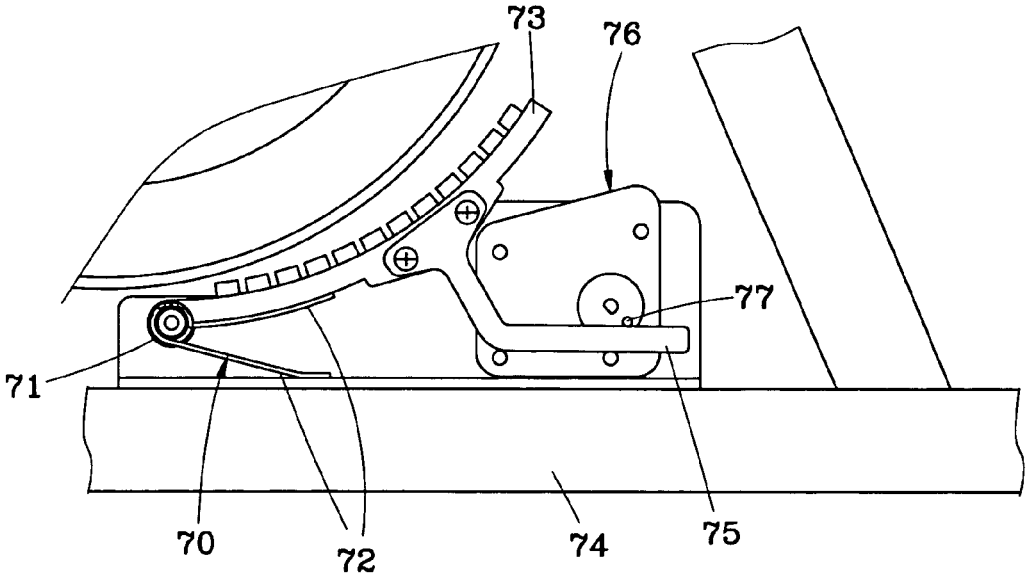
FIG. 4 is a side view of a second preferred embodiment of the present invention mounted on the exercise apparatus.
Figure 5:
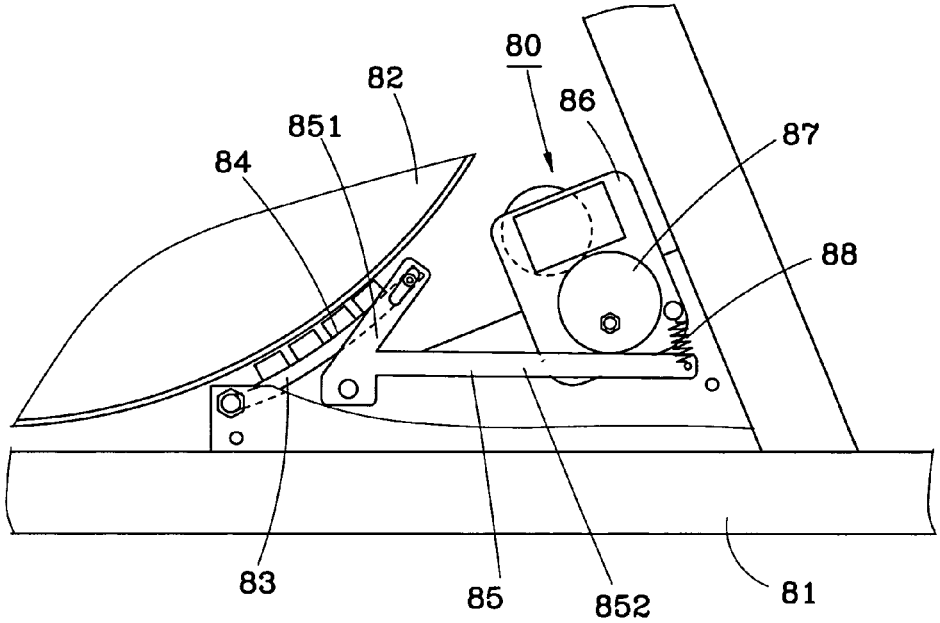
FIG.5 PRIOR ART
FIG. 5 is a partial enlarged view of the prior art, showing a resistance portion of a pivoting member approaches a resistance wheel.
Figure 6:
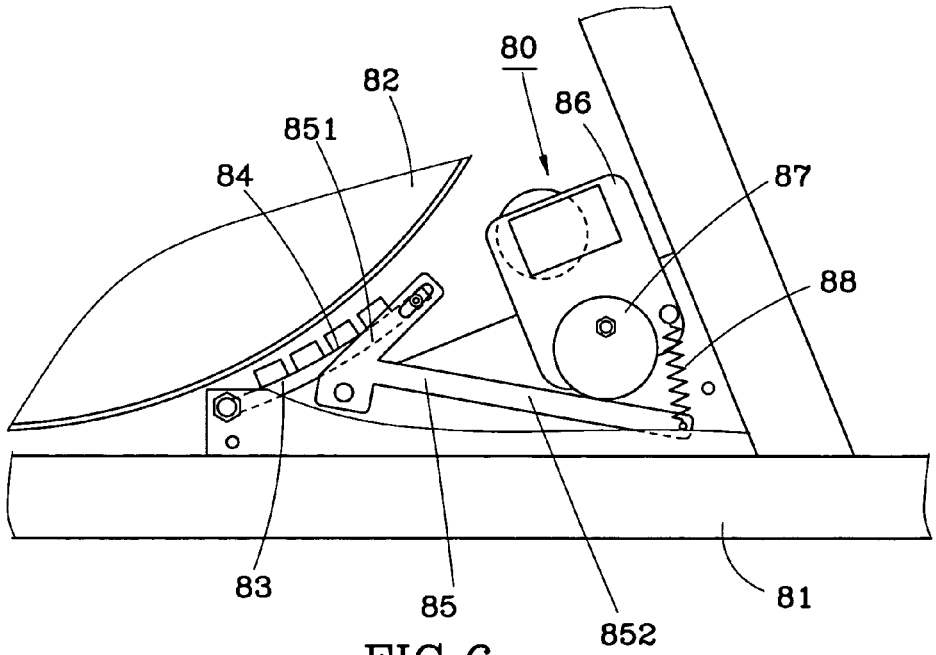
FIG.6 PRIOR ART
FIG. 6 is another partial enlarged view of the prior art, showing the resistance portion of the pivoting member is away from the resistance wheel.

Referring to FIG. 4, the damper adjusting device constructed according to a second preferred embodiment of the present invention is different from the first preferred embodiment by that the biasing member 70 is a torsion spring. The torsion spring 70 includes a spiral portion 71 and two arms 72. The spiral portion 71 is pivotably mounted to the position where the pivoting member 73 is pivoted to the base 74. The two arms 72 respectively contact against the pivoting member 73 and the base 74. When the pivoting member 73 is driven to pivot, the driven portion 75 is under the resilience of the torsion spring 70 to be kept contacting against the lug 77 of the driving mechanism 76.

Moreover, the magnetic unit and the metallic layer can be interchanged by a frictional member, like brake lining, mounted on the resistance portion of the pivoting member. The resistance will be generated while the frictional member frictionally contacts against the resistance wheel. Accordingly, operate the present invention to adjust the distance between the resistance portion and the resistance wheel to change the contact area between the frictional member and the resistance wheel, thereby also attain the same result of shifting the resistance.

What is claimed is:

1. A damper adjusting device mounted on a base of an exercise apparatus, said damper adjusting device comprising:

a resistance wheel rotatably mounted on said base of the exercise apparatus;

a pivoting member pivotably mounted on said base and having a resistance portion and a driven portion, said resistance portion approaching or moving away from said resistance wheel while said pivoting member pivots;

a driving mechanism mounted on said base and having a driving source, a turntable, and a lug, said turntable being driven to rotate by said driving source, said lug being formed on said turntable and spaced from a center of said turntable and positioned at a side of said driven portion of said pivoting member; and a biasing member for generating resilience which keeps said driven portion of said pivoting member contacting against said lug of said driving mechanism, whereby when said lug is driven to move, said pivoting member pivots for an angle and the distance between said resistance portion and said resistance wheel is changed to further adjust resistance generated while said resistance wheel turns.

2. The damper adjusting device as defined in claim 1, further comprising a metallic layer mounted around an outer periphery of said resistance wheel, and a magnet unit mounted on said resistance portion of said pivoting member.

3. The damper adjusting device as defined in claim 1, wherein said biasing member is a tension spring having a top end and a bottom end, said top end being connected to said base over said pivoting member, said bottom end being connected to said pivoting member.

4. The damper adjusting device as defined in claim 1, wherein said biasing member is a torsion spring having two arms respectively contacted against said pivoting member and said base.

* * * * *